US008884726B2

(12) United States Patent
Sun

(10) Patent No.: US 8,884,726 B2
(45) Date of Patent: Nov. 11, 2014

(54) CONTACT STRUCTURE FOR ELECTROMECHANICAL SWITCH

(75) Inventor: Richard Loon Sun, Taichung (TW)

(73) Assignee: Intai Technology Corp., Taichung (TW)

( * ) Notice: Subject to any disclaimer, the term of this patent is extended or adjusted under 35 U.S.C. 154(b) by 118 days.

(21) Appl. No.: 13/204,668

(22) Filed: Aug. 6, 2011

(65) Prior Publication Data

US 2012/0305373 A1 Dec. 6, 2012

(30) Foreign Application Priority Data

Jun. 3, 2011 (TW) ..... 100119622 A

(51) Int. Cl.
*H01P 1/00* (2006.01)
*H01H 1/00* (2006.01)

(52) U.S. Cl.
CPC ..... *H01H 1/0036* (2013.01); *H01H 2001/0052* (2013.01); *H01H 2001/0084* (2013.01)
USPC ..... 333/262; 200/512

(58) Field of Classification Search
USPC ..... 200/512, 181, 292, 244, 240, 241, 247; 335/78–86; 333/262, 105
See application file for complete search history.

(56) References Cited

U.S. PATENT DOCUMENTS

| | | | | |
|---|---|---|---|---|
| 6,307,452 | B1 * | 10/2001 | Sun | 333/262 |
| 6,373,007 | B1 * | 4/2002 | Calcatera et al. | 200/181 |
| 6,593,672 | B2 * | 7/2003 | Ma et al. | 307/109 |
| 7,348,513 | B2 * | 3/2008 | Lin | 200/512 |
| 7,471,031 | B2 * | 12/2008 | Kawakubo et al. | 310/330 |
| 2007/0163866 | A1 * | 7/2007 | Tsai | 200/292 |
| 2007/0290773 | A1 * | 12/2007 | Bar et al. | 333/262 |
| 2009/0014296 | A1 * | 1/2009 | Weber et al. | 200/181 |
| 2011/0024274 | A1 * | 2/2011 | Yoshihara et al. | 200/181 |

* cited by examiner

*Primary Examiner* — R S Luebke
*Assistant Examiner* — Harshad Patel
(74) *Attorney, Agent, or Firm* — CKC & Partners Co., Ltd.

(57) ABSTRACT

A contact structure for electromechanical switch includes a static contact and a moving contact to allow many kinds of actuations and provide great switch characteristics, such as high isolation and low insertion loss, for using in the applicable range from DC to high frequency microwave. In the contact structure, there is a gap disposed between the static contact and the moving contact so that the static contact and the moving contact are parallel with each other.

5 Claims, 6 Drawing Sheets

CONTACT STRUCTURE FOR ELECTROMECHANICAL SWITCH

TECHNICAL FIELD

This invention relates to an electromechanical switch, more particularly to a contact structure for electromechanical switch. The contact structure includes a PCB based construction and a moving contact to allow many kinds of actuations and provide great switch characteristics, such as high isolation and low insertion loss, in the applicable range from DC to microwave.

BACKGROUND OF THE INVENTION

The electronic signal transmission speed required to be processed is growing fast with the technology progress, so that the control switches or relays are required to be capable of processing signals at 1 GHz or higher frequency. The electromechanical switches or relays are for connecting or disconnecting current or circuitry with a mechanical design. The traditional contact structure of electromechanical switches is only capable of transmitting DC or extremely low frequency signals. If a processing device for high frequency signals desires to be added to the traditional contact structure with mechanical design, it will encounter problems such as large-scale cost increase and difficulties in mass production.

The MEMS switch or relay is used for resolving the problems mentioned above. In brief, it is fabricated on the silicon wafer using semiconductor technology with a potential of mass production. The micro design is capable of minimizing the volume of the switches or relays. The typical MEMS switch 5, as shown in FIGS. 1 and 2, has a pair of electrodes 11 and 14, which are separated by a thin dielectric layer 12 and an air gap or cavity 13 defined by a dielectric standoff 16. The electrode 14 is mounted on a diaphragm or a moving beam capable of mechanical displacement, and the other electrode 11 is jointed on a substrate and can not move freely. The switch 5 has two states, that is open (shown as FIG. 1) or close (shown as FIG. 2).

The MEMS switch is very small, so that the charged dielectric medium and effects of static friction always interfere with the stable actuation and release. Low insertion loss and high isolation both are acquired while the MEMS is used in the transmission of high frequency electronic signals, and will limit the gap between the electrodes 11 and 14. Therefore, the MEMS switch is restricted while being used for transmitting the high frequency electronic signals.

In addition, the MEMS is fabricated with semiconductor technology, and the processes include repeatedly oxidizing, depositing, transferring, and etching. The processes are complicated and the steps are numerous. If one of the processes is not properly performed, the entire element must be reworked, resulting in increased manufacturing time and cost.

SUMMARY OF THE INVENTION

The objective of this invention is to provide a contact structure for electromechanical switch, which provides stable switch characteristics, has low insertion loss while ON, and has high isolation while OFF.

The contact structure of this invention works with low driving voltage.

The contact structure of this invention allows many kinds of actuations, such as electrostatic force, electro-magnetic force, piezoelectric effect, or heat effect.

The contact structure of this invention can be applied to the switch or relay with the range from DC to microwave, and is capable of processing signals at a frequency of 1 GHz or higher.

The contact structure of this invention uses a PCB structure and is suitable for low cost mass production. Compared to traditional MEMS switch, the switch of this invention has lower manufacturing cost and simpler manufacturing method.

The contact structure of this invention is capable of minimizing the volume of the MEMS switch.

The PCB and moving contact are designed in the contact structure of this invention. Although the PCB has already been used in RF switch and thin film switch, the switch of this invention still possesses many characteristics to make it different from the PCB base in RF switch and thin film switch, which include:

(a) The RF switch is capacitive type, and not suitable for direct current and can not be a current switch or relay. However, the switch of this invention is suitable as a current switch or relay.

(b) The RF switch is driven by electrostatic force which needs high driving voltage and very small actuation gap that does not match the conditions of low driving voltage and large separated gap.

(c) The printed circuits of the RF switch are integrated on a PCB, but the contact structure of this invention is an independent configuration for using.

(d) The thin film switch generally means a push switch, not an electromechanical switch, which is suitable for the conditions with a switch power lower than 1W, maximum operating voltage of 42V(DC) or 25V(DC), minimum operating current smaller than 100 mA. The thin film switch is not suitable for matching traditional electromechanical actuating device, and further not suitable for processing high frequency signals.

Other features or advantages of the present invention will be apparent from the following drawings and detailed description of several embodiments, and also from the appending claims.

DETAILED DESCRIPTION OF THE INVENTION

The specific examples below are to be construed as merely illustrative, and not limitative, of the remainder of the disclosure in any way whatsoever. Without further elaboration, it is believed that one skilled in the art can, based on the description herein, utilize the present invention to its fullest extent. Further, any mechanism proposed below does not in any way restrict the scope of the claimed invention.

Figure 1:
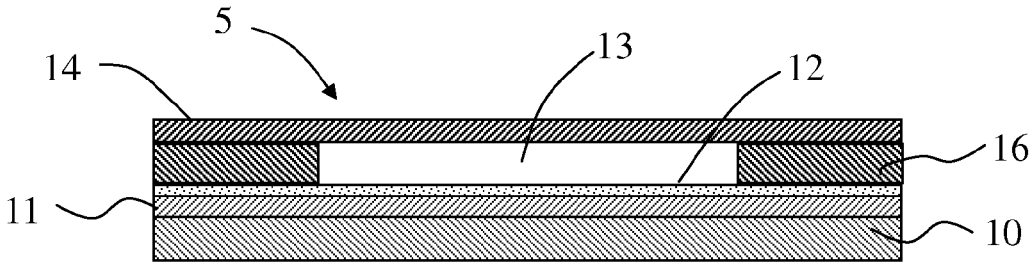
FIG. 1 PRIOR ART
FIG. 1 shows a cross-section diagram of a typical MEMS switch.
Figure 2:
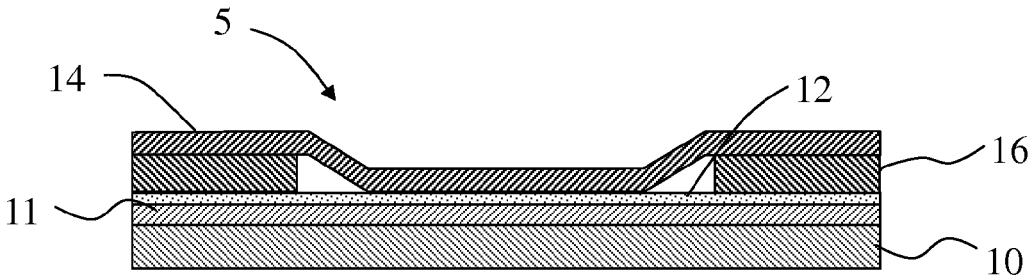
FIG. 2 PRIOR ART
FIG. 2 shows a cross-section diagram of the typical MEMS switch when it is actuated.
Figure 3:
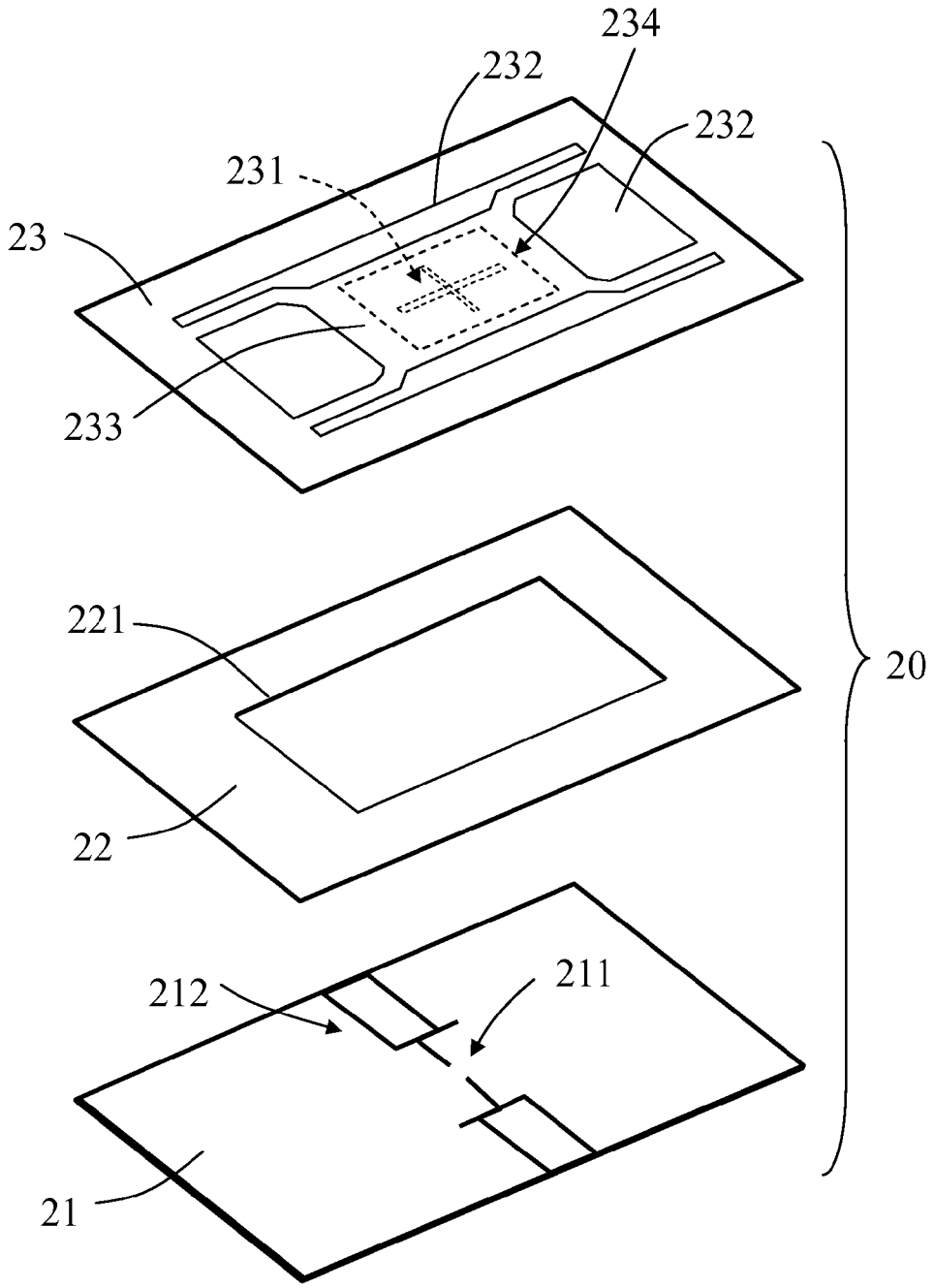
FIG. 3 shows an exploded diagram of the contact structure according to this invention.
Figure 4:
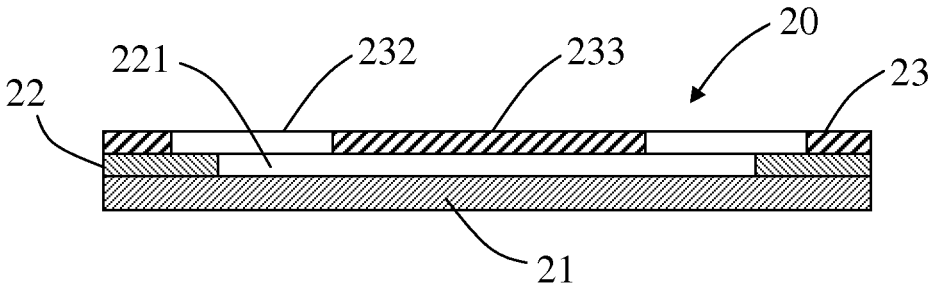
FIG. 4 shows a cross-section diagram of the contact structure according to this invention.

Please refer to FIGS. 3 and 4, a contact structure 20 includes a plurality of PCBs in a stack, which comprise a basic layer 21, a spacing layer 22, and a top layer 23 from bottom to top.

The basic layer 21 is made of a rigid material but not limited to insulation material, such as FR4, or a material capable of responding to a certain range of microwave frequency, such as RO4003 high frequency circuit board material. A lower surface of the basic layer 21 has a grounding structure (not shown) which is formed by metalizing the lower surface of the basic layer 21. Signal traces are set on an upper surface of the basic layer 21 by printed circuit technology to form static contacts 211.

The spacing layer 22 is arranged on the upper surface of the basic layer 21. The material of the spacing layer 22 is not limited to any PCB materials, such like kapton, typical FR4, or solid bonding film made from acrylic with a predetermined thickness. The spacing layer 22 includes a window 221 to expose the static contacts 211 of the basic layer 21 through the spacing layer 22.

The top layer 23 is arranged on the upper surface of the spacing layer 22, and is made from a flexible circuit board material. Metal traces are set on a lower surface of the top layer 23 to form moving contacts 231. The flexible circuit board surrounding the moving contacts 231 is machined by specifically cutting to form a nick 232, so that a floating area 233 surrounds the moving contacts 231. The floatability is meant by that the floating area 233 can be moved downwardly while force is applied and moved upwardly to become flat when the force is released.

Finally, the basic layer 21, the spacing layer 22 and the top layer 23 are stacked together, as shown in FIG. 4.

The static contacts 211 and the moving contacts 231 are metal conducting paths of geometric shape defined according to their application. Therefore, the layouts of the paths of the static contacts 211 and the moving contacts 231 are decided according to the performance of the switch or relay. Thus, the contact structure 20 of the invention can be used in a wide range of applications from DC to microwave for processing signals at a frequency of 1 GHz or higher, and make it possible to perform a low insertion loss.

The static contacts 211 and the moving contacts 231 have specific impedance individually, which normally is 500Ω. The static contacts 211 and the moving contacts 231 can be micro strips since micro strips provide good impedance control and are suitable for passing high frequency signals. It is possible to reduce the width of the metal conducting paths or the micro strip to reduce the phenomenon of overlapping contact and better isolate the micro-electromechanical switch while the switch is OFF. Besides, the impedance variation resulting from the decrease in the overlapping contact of conductive pathway should be considered. Therefore, a compensation structure is set along the metal conducting paths to compensate the impedance variation. In this embodiment, a tuning circuit 212 is used adjacent to the static contacts 211 and a tuning circuit 234 is used in the vicinity of the moving contacts 231 to realize the compensation structure.

The gap between the static contacts 211 and the moving contacts 231 is defined by the thickness of the spacing layer 22 and the power for the actuation of the contact structure 20. However, a narrow gap is preferable to make sure that the moving contacts 231 contact the static contacts 211 and the power for the actuation of the contact structure 20 is low.

Figure 5:
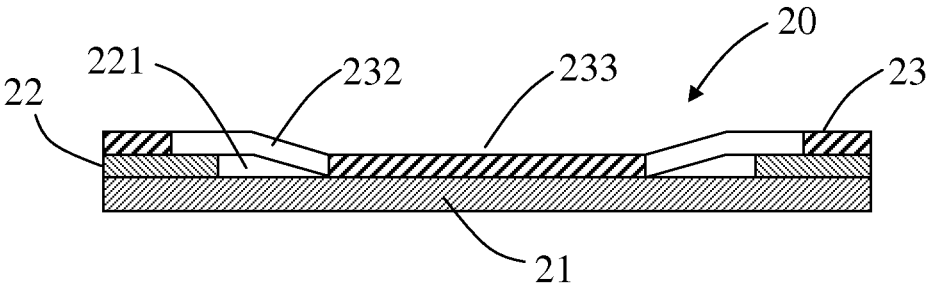
FIG. 5 shows a cross-section diagram of the contact structure according to this invention when it is actuated.

Please refer to FIG. 5, the contact structure 20 is actuated so that the floating area 233 is moved downwardly, and the window 221 of the spacing layer 22 allows the moving contacts 231 to move downwardly to contact the static contacts 211 of the basic layer 21. The actuation is accomplished by ways including but not limited to an actuating device based electrostatics, electromagnetism, piezo effect, and heat effect. The actuating device is coupled to the contact structure 20, and a transmission portion of the actuating device contacts the floating area 233.

Figure 6:
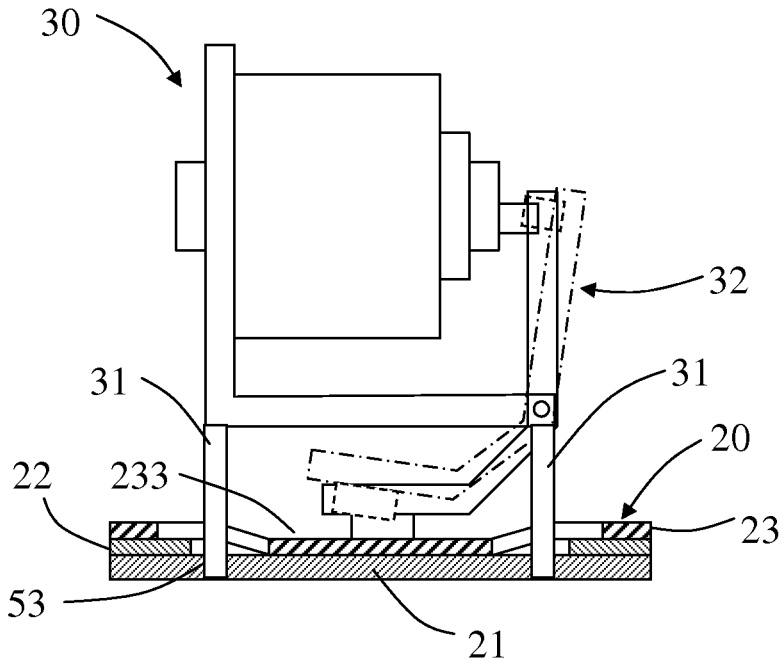
FIG. 6 shows a schematic diagram of a first embodiment of the electromechanical switch with the contact structure according to this invention.

Please refer to FIG. 6, the actuating device may be an electromechanical device 30 that includes a supporting member 31 welded to a lead frame 54 disposed at the bottom of the basic layer 21 via the window 221 of the spacing layer 22 and VIAs 53 disposed at the basic layer 21 in advance. The actuating device 30 further includes a transmission portion 32 that contacts the floating area 233. The movement of the transmission portion 32 drives the floating area 233 downwardly and then pushes the moving contacts 231 to contact the static contacts 211.

Figure 7:
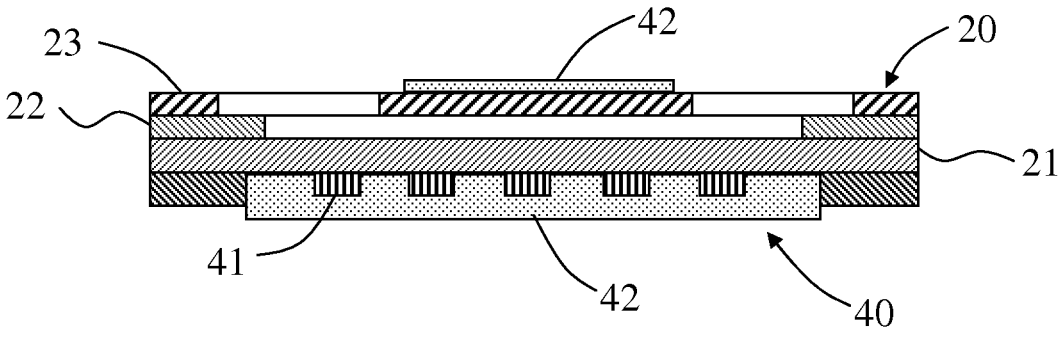
FIG. 7 shows a schematic diagram of a second embodiment of the electromechanical switch with the contact structure according to this invention.

Please refer to FIG. 7, the actuating device may alternatively be an electromagnetic device 40. In the printed circuit process of the contact structure 20, a printed coil 41 is constructed at the bottom of the basic layer 21, and a magnetic material 42 is constructed at the top of the top layer 23 and is coated over the printed coil 41. Electricity goes through the printed coil 41, and the magnetic material 42 makes the moving contacts 231 move downwardly to contact the static contacts 211.

Figure 8:
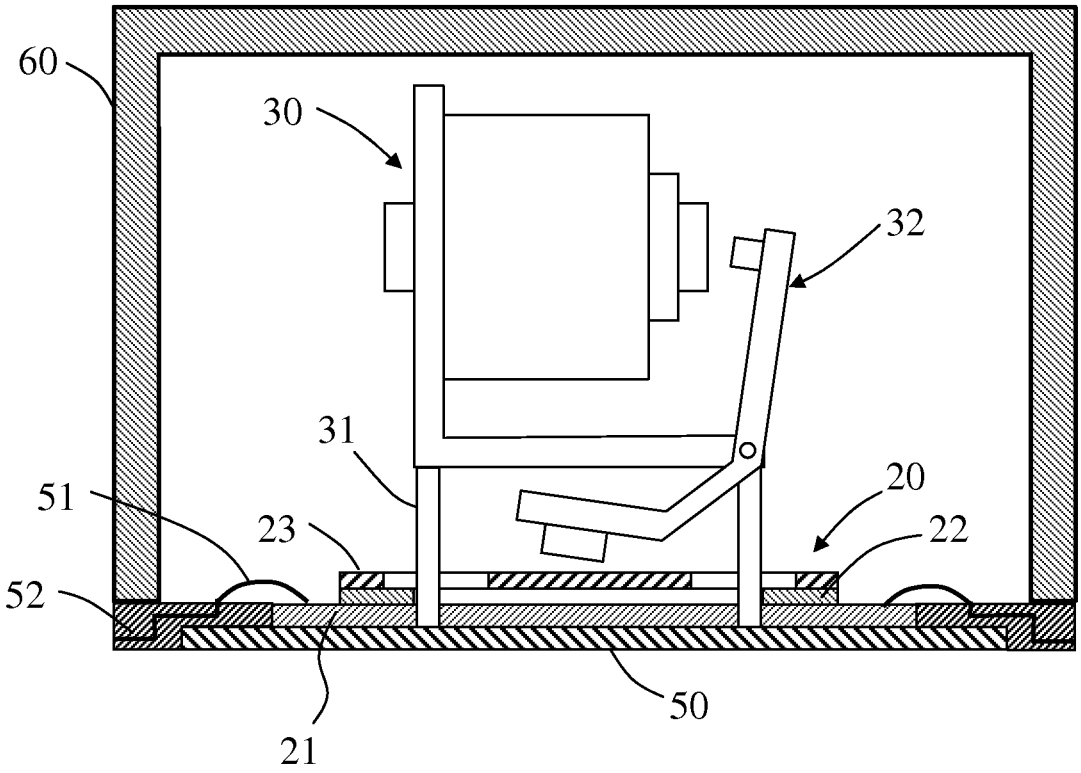
FIG. 8 shows a schematic diagram of a first embodiment of the contact structure packaged with an actuating device according to this invention.
Figure 9:
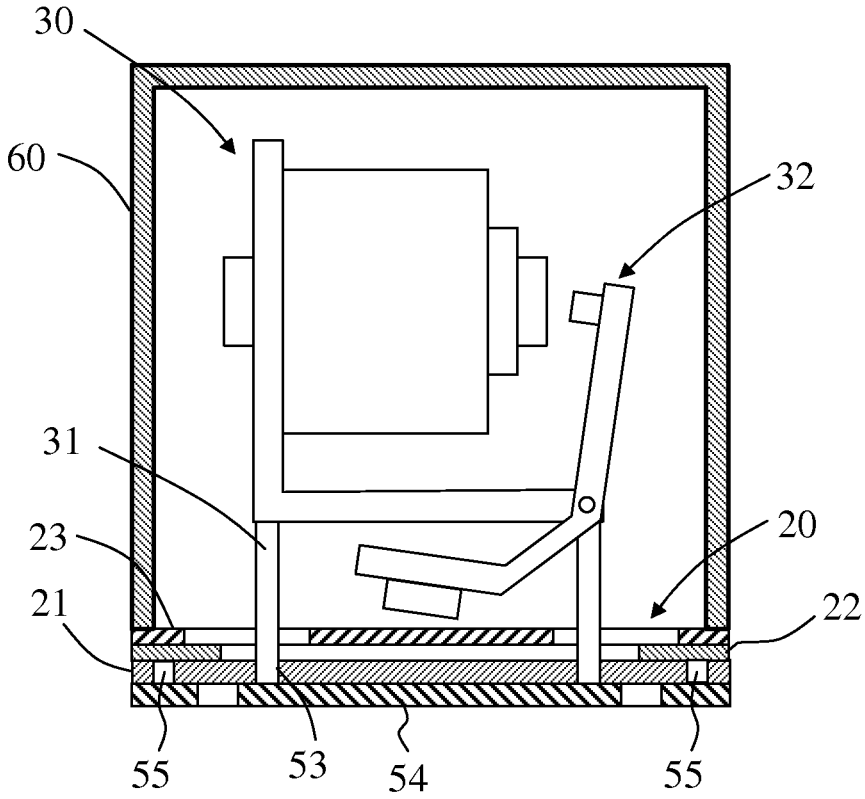
FIG. 9 shows a schematic diagram of a second embodiment of the contact structure packaged with an actuating device according to this invention.

The contact structure 20 and actuating device 30 are packaged by conventional semiconductor packaging techniques as illustrated in FIGS. 8 and 9, respectively. These embodiments are illustrated for the detailed description of the specification, and not intended to limit the application scope of the invention in any way. Furthermore, the switch structures are probably made on a printed circuit board to form a switch network and packaged as a whole according to the requests, instead of being packaged individually.

Please refer to FIG. 8, the actuating device 30 has already been coupled to the contact structure 20. The lower surface of the basic layer 21 is fastened at an isolating substrate or a grounding plate 50. The conducting paths of the contact structure 20 and the coil of the actuating device 40 are connected to preset leads 52 through conducting lines 51. An outer cover 60 closes the whole configuration.

Please refer to FIG. 9, the actuating device 30 has already been coupled to the contact structure 20. One part of the contact structure 20 is packaged. The lower surface of the basic layer 21 has preset layouts of a ground and leads, and the conducting paths arranged at the upper surface of the basic layer 21 are connected to corresponding leads through VIAs 55 in the basic 21. The basic layer 21 is coupled to a lead frame 54 that matches the basic layer 21. The supporting member 31 of the actuating device 30 is welded to the lead frame 54 through the window 221 of the spacing layer 22 and the preset VIA 53 of the basic layer 21. A cover 60 closes the whole configuration.

No matter what the package technology is, the design of the leads must be considered so that it does not result in the interference of the impedance matching of the contact structure 20. Besides, the performance of processing high frequency signal must also be kept.

In summary, the core of this invention is using PCB process and moving contact to form the contact structure of the electromechanical switch. It minimizes the volume of the electromechanical switch, lowers the production and manufacturing cost of the electromechanical switch, allows many kinds of actuations, matches many kinds of actuating devices, and provides the switch with good switch characteristics, such as high isolation and low insertion loss. And the suitable range is from DC to microwave.

From the above description, one skilled in the art can easily ascertain the essential characteristics of the present invention, and without departing from the spirit and scope thereof, can make various changes and modifications of the invention to adapt it to various usages and conditions. Thus, those other embodiments should also be within the scope of the claims.

What is claimed is:

1. A contact structure of an electromechanical switch for allowing a microwave signal transmitted therewith, comprising:

a basic layer made of a printed circuit board and including a static contact made of a printed conducting path on an upper face and a tuning circuit in the vicinity of the static contact;

a top layer made of a flexible circuit board and including a floating area made by a nick therein, a moving contact made of a printed conducting path on a lower face of the floating area, and a tuning circuit in the vicinity of the moving contact; and a spacing layer sandwiched between the basic layer and the top layer and formed with a window through which the static contact of the basic layer is exposed to the moving, contact of the top layer, wherein the spacing layer is made with even thickness to provide a gap disposed between the static contact and the moving contact so that the static contact and the moving contact are parallel with each other;

wherein the moving contact and the static contact are micro strips for allowing the microwave signal transmitted therein, and each of the static contact and the moving contact has a predetermined line width to render a minimum overlapping contact to improve isolation;

wherein the moving contact is actuated to move and then contact the static contact for transmitting the microwave signal, and the tuning circuits in the vicinity of the static contact and the moving contact compensates impedance variation induced between the moving contact and the static contact due to line width change.

2. The contact structure of claim 1, wherein a grounding structure is arranged at a lower surface of the basic layer.

3. The contact structure of claim 2, wherein a lead for packaging is arranged at the lower surface of the basic layer.

4. An electromechanical switch having the contact structure of claim 3, comprising:

an actuation device coupled to the contact structure, comprising:

a supporting member fixed to the basic laver: and a transmission portion of the actuating device contacting the top layer having the floating area:

wherein a movement of the transmission portion drives the floating area to move downwardly and then pushes the moving contacts to contact the static contacts in order for allowing the microwave signal transmitted therein.

5. The electromechanical switch of claim 4, wherein the actuation device comprises:

a printed coil constructed at the bottom of the basic layer; and a magnetic material constructed at the top of the top layer and coated over the printed coil;

wherein when a current is passed through the printed coil, the magnetic material makes the moving contacts move downwardly to contact the static contacts.

* * * * *